US007303248B2

(12) United States Patent
Liao et al.

(10) Patent No.: US 7,303,248 B2
(45) Date of Patent: Dec. 4, 2007

(54) METHOD AND PRINTHEAD CAPABLE OF SEARCHING FOR AN OPTIMAL TEMPERATURE OF AN INK JET CHIP OF A PRINTHEAD BEFORE PRINTING

(75) Inventors: Hsieh-Sheng Liao, Yun-Lin Hsien (TW); Cheng-Lung Lee, Taipei (TW)

(73) Assignee: BenQ Corporation, Gueishan, Tao-Yuan Hsien (TW)

( * ) Notice: Subject to any disclaimer, the term of this patent is extended or adjusted under 35 U.S.C. 154(b) by 247 days.

(21) Appl. No.: 11/161,620

(22) Filed: Aug. 10, 2005

(65) Prior Publication Data

US 2006/0038848 A1 Feb. 23, 2006

(30) Foreign Application Priority Data

Aug. 18, 2004 (TW) ..... 93124834 A

(51) Int. Cl.
*B41J 29/38* (2006.01)
*B41J 29/393* (2006.01)

(52) U.S. Cl. ..... 347/17; 347/14; 347/19

(58) Field of Classification Search ..... 347/17
See application file for complete search history.

(56) References Cited

U.S. PATENT DOCUMENTS

2002/0140753 A1 10/2002 Danzuka et al.
2004/0239711 A1* 12/2004 Koehler et al. ..... 347/19

* cited by examiner

*Primary Examiner*—Matthew Luu
*Assistant Examiner*—Jannelle M. Lebrón
(74) *Attorney, Agent, or Firm*—Winston Hsu

(57) ABSTRACT

A method for searching for an optimal temperature of an ink jet chip of a printhead before printing includes controlling the printhead to print a swath of data according to a predetermined swath density, measuring the temperature of the ink jet chip after printing of the swath of data, and comparing the measured temperature with a target temperature.

3 Claims, 6 Drawing Sheets

METHOD AND PRINTHEAD CAPABLE OF SEARCHING FOR AN OPTIMAL TEMPERATURE OF AN INK JET CHIP OF A PRINTHEAD BEFORE PRINTING

BACKGROUND OF THE INVENTION

1. Field of the Invention

The present invention relates to a method for searching for an optimal temperature of an inkjet chip of a printhead, and more particularly, to a method for searching for an optimal temperature of an ink jet chip of a printhead for a predetermined swath density.

2. Description of the Prior Art

Ink jet printers provide good printing quality at a fair price and as a result, have become the most popular printing equipment. With the quick advancement of technology, better printing quality has been a target that information industrial circles work to achieve. Generally speaking, an ink jet printer, such as a bubble-jet printer, uses heating elements of the printhead to heat ink. When the energy level imparted to the heating elements is high enough, ink becomes bubbles and is jetted from the nozzles of the printhead. The ink consumes a part of the energy. However, the remaining part of the expended energy will stay in the printhead so that the temperature of the printhead increases.

After the temperature of the printhead exceeds a maximum temperature $T_{max}$ at which the printhead can operate normally, printing quality deteriorates. Therefore, most manufacturers control or limit a threshold temperature of a printer to ensure that the temperature of the ink jet chip will not exceed the maximum temperature $T_{max}$ during printing. When the printhead finishes printing a swath, the best condition is that the temperature of the ink jet chip is about the maximum temperature $T_{max}$ at which the printhead can operate normally.

When printing higher swath densities, the temperature variations of the ink jet chip are larger. That is, the temperature of the ink jet chip shows a larger growth during printing. On the contrary, for lower swath densities, the temperature variation of the ink jet chip is smaller. In other words, when printing lower swath densities, the temperature of the ink jet chip increases during printing, but the increase is less than the increase when printing higher swath densities. Of course, if the threshold temperature $T_{threshold}$ of the printhead, meaning the temperature to which the ink jet chip is preheated before commencing printing, is set to a lower temperature, this can ensure that the temperature of the ink jet chip does not exceed the maximum temperature $T_{max}$ at which the ink jet chip can operate normally. However, when printing lower swath densities using such a printhead, after finishing printing, the finishing temperature of the ink jet chip is much lower than the maximum temperature $T_{max}$ so that printing quality is poor and standby time is increased due to the smaller temperature variations and the lower threshold temperature $T_{threshold}$. If the threshold temperature $T_{threshold}$ is set to a higher temperature in order to optimize printing quality, the temperature variations of the ink jet chip are too large when printing higher swath densities. What is worse, during printing, the temperature of the ink jet chip exceeds the maximum temperature $T_{max}$, damaging the printhead.

SUMMARY OF THE INVENTION

It is therefore a primary objective of the claimed invention to provide a method for searching for an optimal temperature of an ink jet chip of a printhead before printing to solve the above-mentioned problem.

The claimed invention provides a method for searching for an optimal temperature of an ink jet chip of a printhead before printing. The method comprises controlling the printhead to print data according to a predetermined swath density, measuring the temperature of the ink jet chip after finishing printing the data in the predetermined swath density, and comparing the measured temperature with a target temperature.

These and other objectives of the present invention will no doubt become obvious to those of ordinary skill in the art after reading the following detailed description of the preferred embodiment that is illustrated in the various figures and drawings.

DETAILED DESCRIPTION

The present invention can search for different threshold temperatures for different swath densities so that the temperature of the ink jet chip increases approximately to the maximum temperature $T_{max}$ at which the ink jet chip can operate normally when finishing printing a swath and thereby the purpose of optimizing printing quality is achieved. The threshold temperature is the temperature to which the ink should be heated before beginning the printing of a swath. After the printhead finishes printing a swath with lower swath density, the temperature variation of the ink jet chip, e.g. the difference between the threshold temperature and the finishing temperature, is smaller. Hence, the threshold temperature $Tl_{threshold}$ of lower swath density can be set higher so that the finishing temperature of the ink jet chip is near the maximum temperature $T_{max}$. Conversely, after the printhead finishes printing a swath with higher swath density, the temperature variation of the ink jet chip is larger. The threshold temperature $Th_{threshold}$ of higher swath density therefore can be set lower so that the finishing temperature of the ink jet chip is about the maximum temperature $T_{max}$. For the same printhead, $Tl_{threshold}$ must be higher than $Th_{threshold}$ to improve the performance of the printer.

The present invention also provides different test patterns for different swath densities. After the printer prints the test patterns, the temperature $T_{feedback}$ of the ink jet chip is measured so that the present invention can automatically search for each optimal threshold temperature $T_{threshold}$ for different swath densities before printing.

Figure 1:
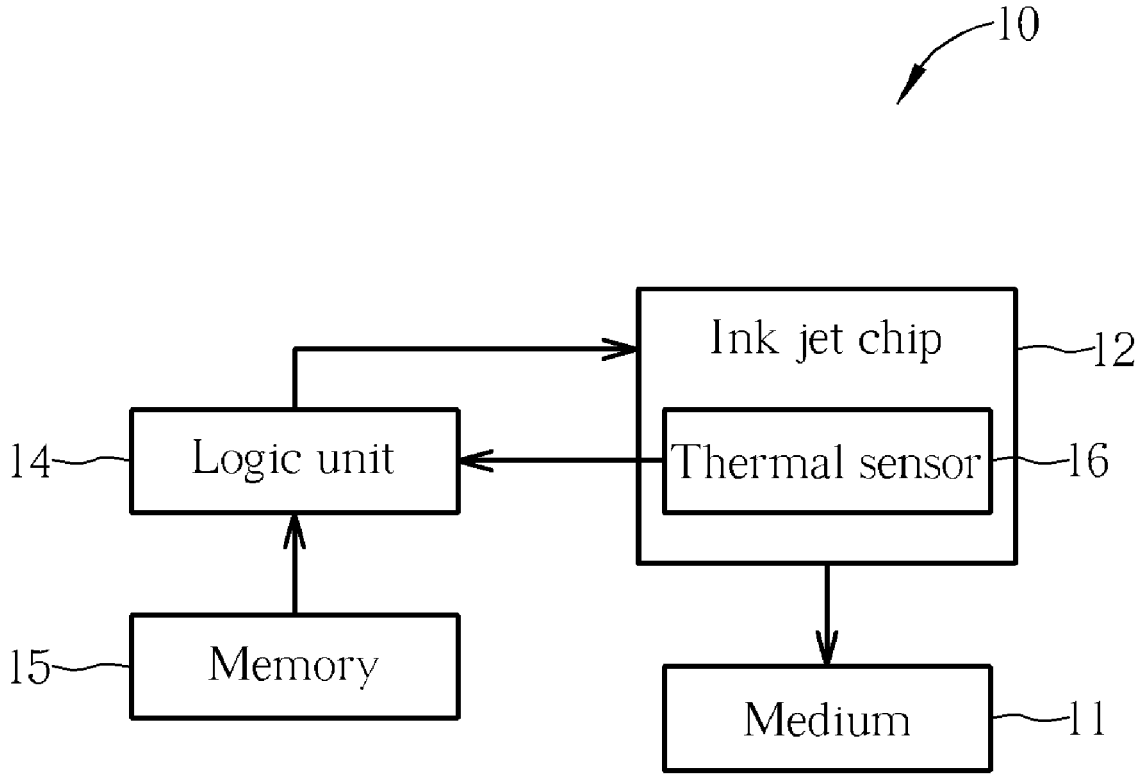
FIG. 1 is a diagram of a printhead according to the present invention.
Figure 2:
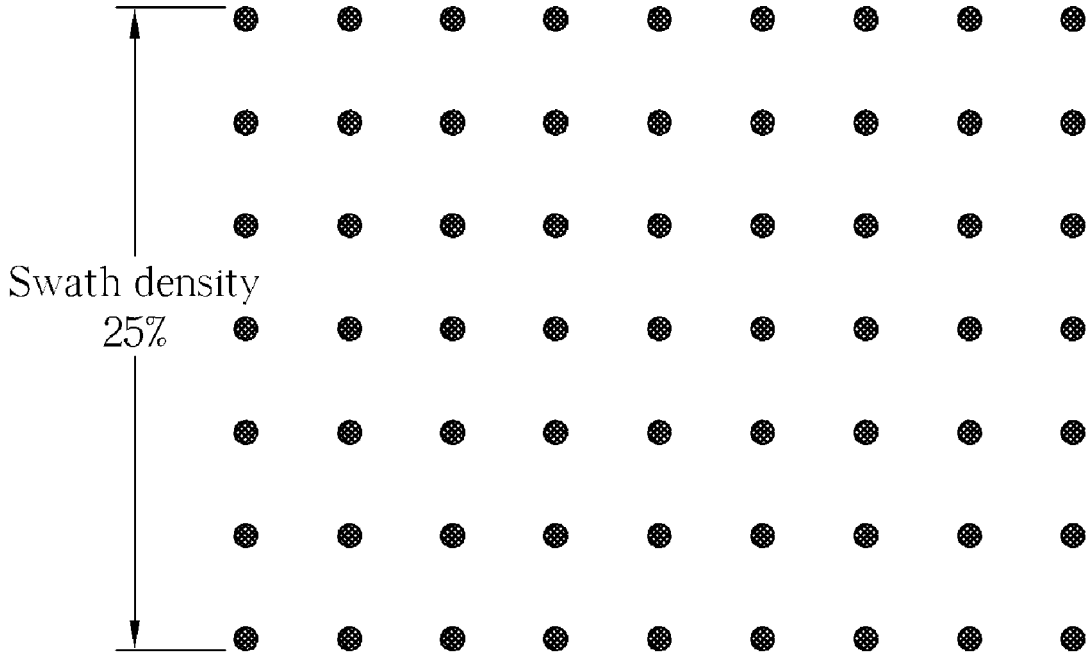
FIG. 2 to FIG. 5 are test patterns for different swath densities.
Figure 3:
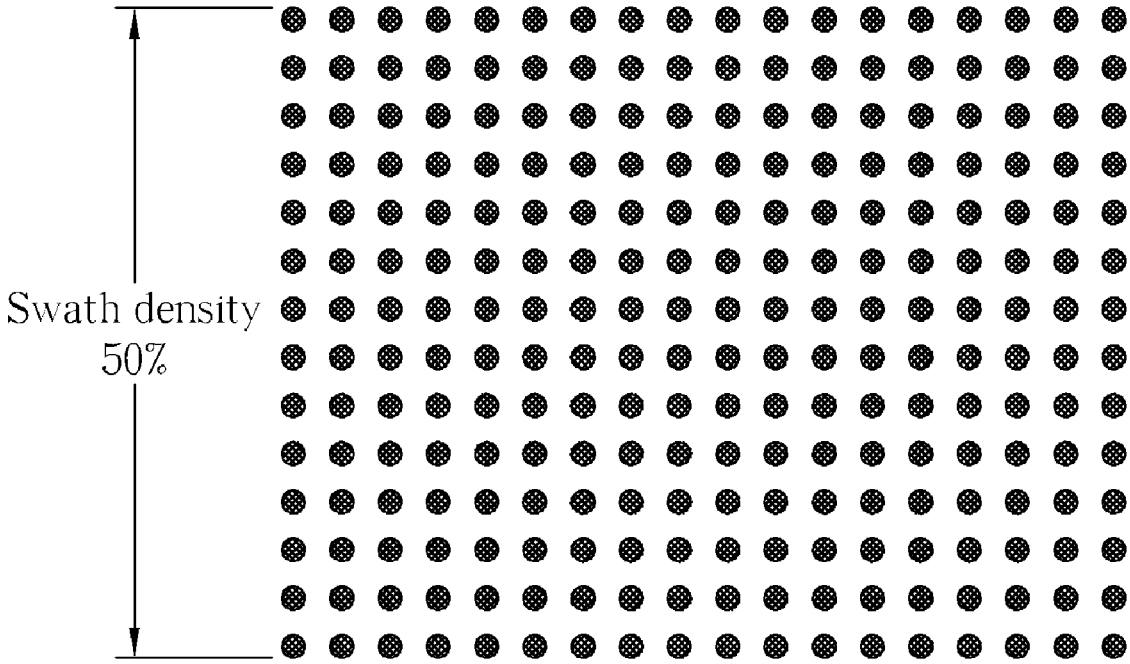
Figure 4:
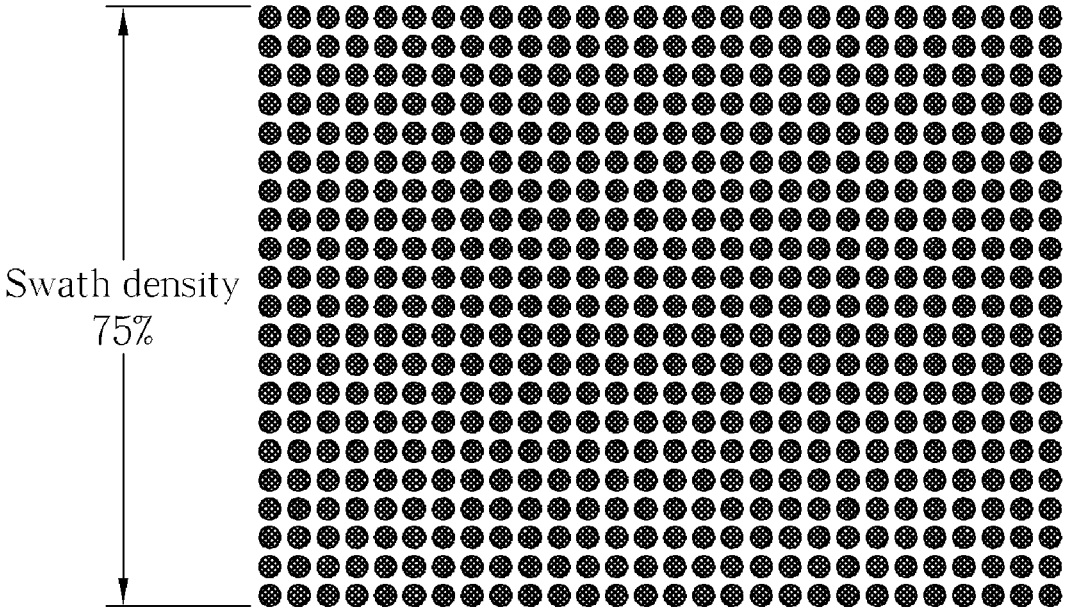
Figure 5:
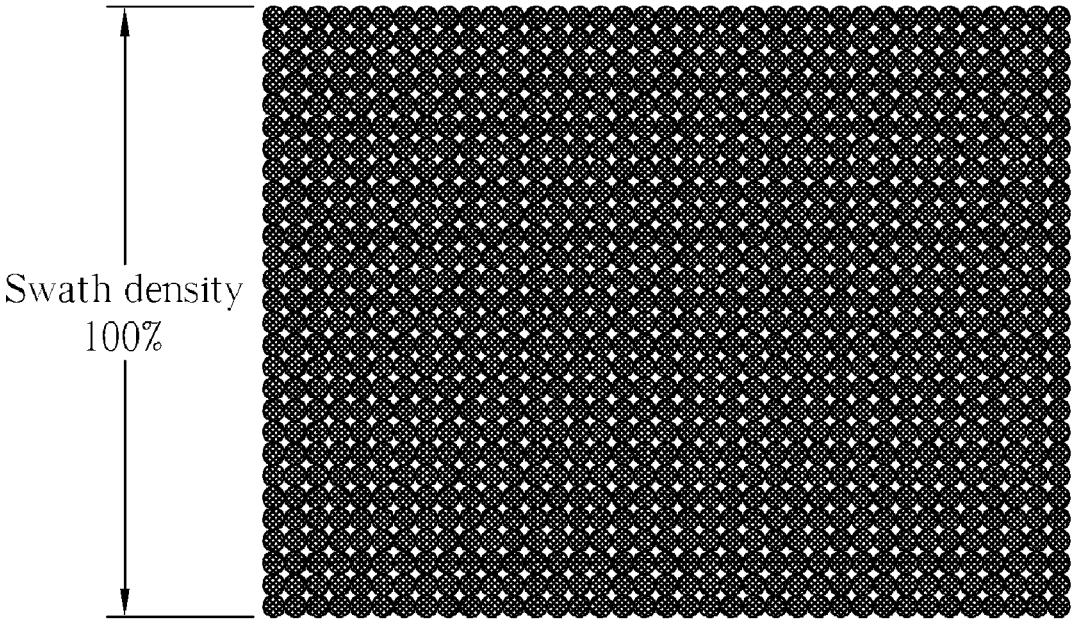

Please refer to FIG. 1, which is a diagram of a printhead 10 of the present invention. The printhead 10 comprises an ink jet chip 12 and a logic unit 14. First, the logic unit 14 heats the ink jet chip 12 to a predetermined temperature $T_{predetermined}$. Next, the logic unit 14 obtains a test pattern from a memory 15 of the printhead 10 to control the printhead 10 to print the test pattern on a medium 11. After completing the print, a thermal sensor 16 of the ink jet chip 12 measures the temperature $T_{feedback}$ of the ink jet chip 12 and $T_{feedback}$ is transmitted to the logic unit 14. The logic unit 14 compares the measured temperature $T_{feedback}$ with a target temperature $T_{target}$ to automatically search for the optimal threshold temperature $T_{threshold}$.

Please refer to FIG. 2 to FIG. 5, which are test patterns for different swath densities. The swath density difference between each figure is 25%. However, the test patterns of the present invention are not intended to be limited as above. Test patterns can be designed for more levels of swath densities. Therefore, the present invention can utilize the test patterns to continuously search for optimal temperatures for different swath densities before printing.

Figure 6:
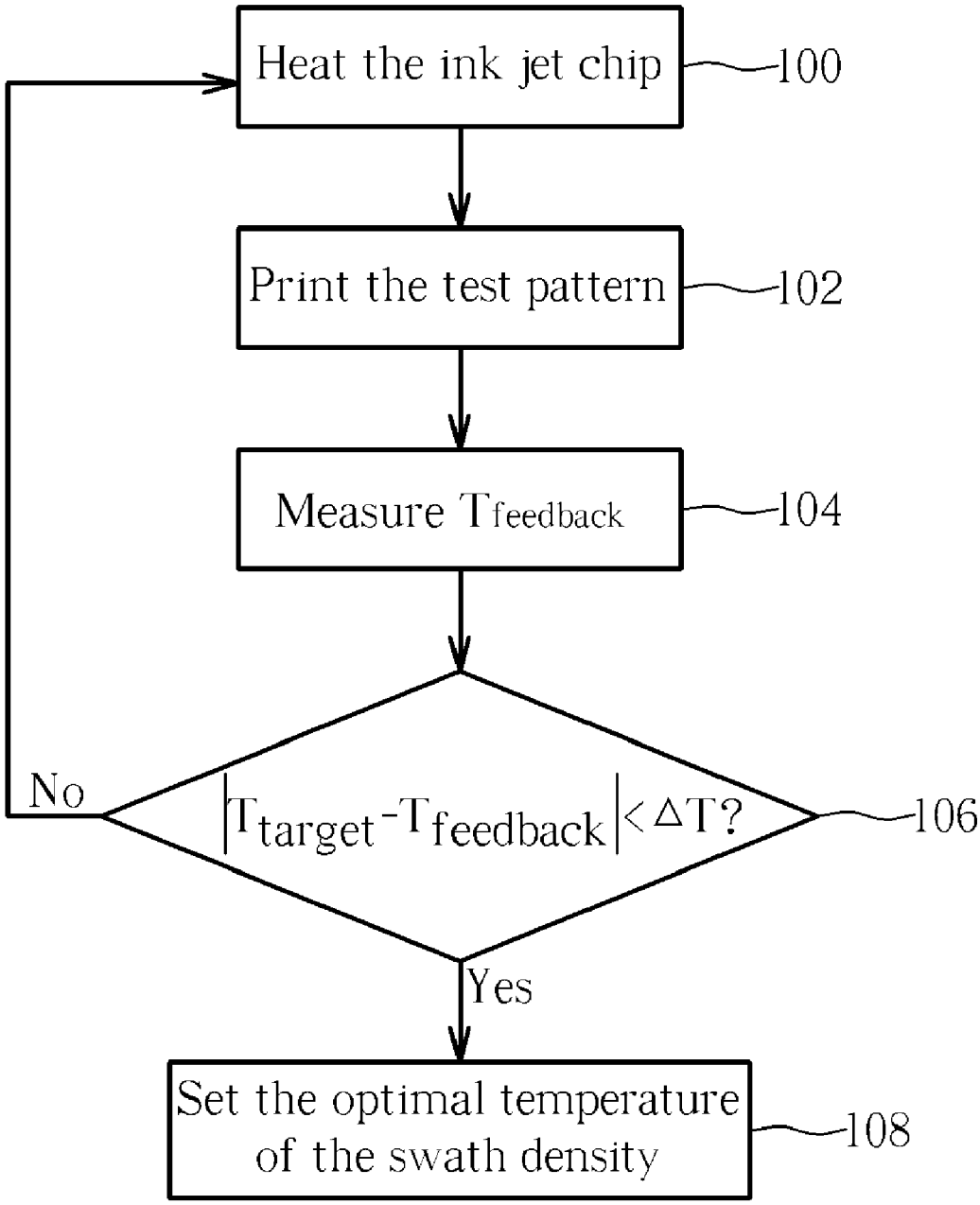
FIG. 6 is a flowchart of searching for an optimal temperature of an ink jet chip before printing according to the present invention.

Please refer to FIG. 6, which is a flowchart of searching for the optimal temperature according to the present invention. The steps are as follows:

Step 100: Heat the ink jet chip 12 to a predetermined temperature $T_{predetermined}$ for the swath density to be printed.

Step 102: The printhead 10 prints the test pattern of the swath density.

Step 104: The thermal sensor 16 of the ink jet chip 12 measures the temperature $T_{feedback}$ of the ink jet chip 12 after finishing printing the test pattern.

Step 106: Compare the measured temperature $T_{feedback}$ of step 104 with a target temperature $T_{target}$. If the difference of the measured temperature $T_{feedback}$ and the target temperature $T_{target}$ is within a predetermined range, go to step 108. Otherwise, go back to step 100 to heat the ink jet chip 12 to an adjusted predetermined temperature.

Step 108: Set the predetermined temperature $T_{predetermined}$ as the optimal threshold temperature of the swath density.

Details of Step 106 in FIG. 6 are described as follows. The difference is derived from the absolute value of subtracting $T_{feedback}$ from $T_{target}$. If the difference is smaller than a predetermined range $\Delta T$, enter step 108. That is, the optimal threshold temperature of the swath density is found. If the difference is larger than a predetermined range $\Delta T$, the predetermined temperature $T_{predetermined}$ is increased (or decreased when necessary) and step 100 to 106 are repeated until the optimal threshold temperature of the swath density is found. For example, the predetermined temperature $T_{predetermined}$ is increased by three degrees centigrade.

Suppose that the maximum temperature $T_{max}$ is 50 degrees centigrade and $\Delta T$ is 1.5 degrees centigrade. The target temperature $T_{target}$ is set to 50 degrees centigrade. If the predetermined temperature $T_{predetermined}$ is set to 35 degrees centigrade and the measured temperature $T_{feedback}$, after finishing printing the test pattern, is about 48 degrees centigrade, the difference ($|T_{target}-T_{feedback}|=2$) is two, which is larger than $\Delta T=1.5$. Therefore, the predetermined temperature $T_{predetermined}$ is increased from 35 degrees centigrade to 38 degrees centigrade and steps are repeated. After finishing the test pattern, the measured temperature $T_{feedback}$ is 51 degrees centigrade. The difference ($|T_{target}-T_{feedback}|=1$) is one, which is smaller than $\Delta T=1.5$. The optimal threshold temperature $T_{threshold}$ is found and is set to 38 degrees centigrade.

Of course, the method of step 106 is not limited as above. Another method is to determine if the measured temperature $T_{feedback}$ is about the maximum temperature $T_{max}$, but not over $T_{max}$, to avoid the temperature of the ink jet chip 12 exceeding $T_{max}$. In this case, the optimal threshold temperature $T_{threshold}$ is set to 35 degrees centigrade instead of 38 degrees centigrade. If the optimal threshold temperature $T_{threshold}$ is set to 38 degrees centigrade, the measured temperature $T_{feedback}$, after finishing printing the test pattern, is 51 degrees centigrade, which exceeds $T_{max}=50$. Although the measured temperature (51 degrees centigrade) for $T_{predetermined}$ 38 degrees centigrade is much closer to $T_{max}$ (50 degrees centigrade) than the measured temperature (48 degrees centigrade) for $T_{predetermined}$ 35 degrees centigrade, the measured 51 degrees centigrade is over $T_{max}=50$. Therefore, the optimal threshold temperature $T_{threshold}$ is not set to 38 degrees centigrade and instead, is set to 35 degrees centigrade.

When room temperature changes or the printhead 10 is changed, the printer can use the method of the present invention to search for the optimal threshold temperature in the present environment before printing. In addition, the thermal sensor 16 of the present invention is a thermistor or other device for measuring temperature.

Compared to the prior art, the present invention can search for threshold temperatures $T_{threshold}$ for different swath densities so that the temperature of the ink jet chip 12 is close to $T_{max}$ after the printhead 10 finishes printing a swath. The present invention can solve the prior art problem where no matter which swath density is printed, the ink jet chip must be heated to the same threshold temperature.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for searching an optimal temperature of an ink jet chip of a printhead before printing, the method comprising:

receiving print data having a predetermined swath density;

heating the ink jet chip to a predetermined temperature corresponding to the predetermined swath density of the print data;

controlling the printhead to print the print data having the predetermined swath density after heating the ink jet chip to the predetermined temperature;

measuring the temperature of the ink jet chip after finishing printing the print data of the predetermined swath density;

comparing the measured temperature with a target temperature; and setting the predetermined temperature as an optimal threshold temperature of the ink jet chip corresponding to the predetermined swath density when the difference between the measured temperature and the target temperature is within a predetermined range.

2. The method of claim 1 further comprising adjusting the predetermined temperature corresponding to the predetermined swath density to another temperature before printing print data of the same predetermined swath density when the difference between the measured temperature and the target temperature is not within a predetermined range.

3. The method of claim 1 wherein measuring the temperature of the ink jet chip is achieved via a thermal sensor in the ink jet chip.

* * * * *